United States Patent [19]

Chabot

[11] Patent Number: 4,595,100

[45] Date of Patent: Jun. 17, 1986

[54] COIN HOLDER

[76] Inventor: Paul-André Chabot, 736 Baker Street, Vanier, Canada, G1M 2T9

[21] Appl. No.: 648,217

[22] Filed: Sep. 7, 1984

[51] Int. Cl.[4] ..... B65D 83/04; B65D 85/58; G07D 9/00

[52] U.S. Cl. ..... 206/0.82; 206/445; 53/254; 133/1 A; 229/93

[58] Field of Search ..... 206/0.8–0.83, 206/445; 229/93; 133/1 A, 8 A; 53/254; 493/945

[56] References Cited

U.S. PATENT DOCUMENTS

| | | | |
|---|---|---|---|
| 837,685 | 12/1906 | Kintz | 206/0.81 X |
| 2,802,325 | 8/1957 | Capodanno . | |
| 2,808,925 | 10/1957 | O'Rielly | 206/0.82 |
| 2,836,019 | 5/1958 | Oltarzewski . | |
| 2,977,736 | 4/1961 | Condis . | |
| 2,996,864 | 8/1961 | Cook . | |
| 3,073,432 | 1/1963 | Low et al. | 206/0.82 |
| 3,085,378 | 4/1963 | Howard . | |
| 3,139,976 | 7/1964 | Swain | 206/0.82 |
| 3,312,336 | 4/1967 | Fally | 206/0.82 |
| 3,412,524 | 11/1968 | Nestell et al. . | |
| 3,476,240 | 11/1969 | Howell | 206/0.82 X |
| 4,036,358 | 7/1977 | Kelley | 206/0.82 |
| 4,399,910 | 8/1983 | Gutentag | 206/0.82 |
| 4,402,399 | 9/1983 | Friess | 206/0.83 |

FOREIGN PATENT DOCUMENTS

| | | | |
|---|---|---|---|
| 469476 | 11/1950 | Canada . | |
| 595497 | 4/1960 | Canada . | |
| 797568 | 10/1968 | Canada . | |
| 813120 | 5/1969 | Canada . | |
| 659209 | 4/1938 | Fed. Rep. of Germany | 206/0.82 |
| 1519820 | 2/1968 | France | 206/0.8 |

*Primary Examiner*—William Price
*Assistant Examiner*—Sue A. Weaver

[57] ABSTRACT

There is disclosed a one-piece coin holder having a main cylindrical wall, an end wall and an opposite open end portion. The latter permits insertion or egress of a predetermined number of coins into or from the holder. The open end portion defines an inner cylindrical bulge with bevelled outer and inner edge faces, the latter merging with the inside surface of the main wall of the coin holder. The latter is made of slightly extensible material. The inner diameter of the main wall is greater than the diameter of the coins, but the inner diameter of the bulge is smaller than that of the coins, so that the latter are resiliently retained within the coin holder. The latter can advantageously account for coins of varying thickness, according to their wear condition, while maintaining exactly the same predetermined number of coins.

2 Claims, 6 Drawing Figures

COIN HOLDER

FIELD OF THE INVENTION

This invention relates to a cylindrical coin holder for containing a predetermined number of coins in the same denomination.

BACKGROUND OF THE INVENTION

Coin holders are used in banking institutions and the like and are in the form of a tube which, when the ends of the tube are closed, contains a predetermined number of coins. This overcomes the necessity of counting the coins before filling the tube and, therefore, obviates the human factor in the risk of miscounting. However, the known tubes require a closing operation and are often made of several parts.

OBJECTS OF THE INVENTION

The prime object of the invention is therefore to provide a re-usable one piece coin holder, in the form of a cylinder, having an open end portion with a very efficient coin retainer embodied therein, said coin holder, when filled, automatically retaining a predetermined number of coins without any additional manipulation.

Another object of the invention is to provide the coin holder with means to account for the degree of wear of the coins, so as to always maintain the same number of coins within the coin holder.

Another object of the invention is to provide a coin holder which is quickly and easily emptied.

SUMMARY OF THE INVENTION

This coin holder is a cylindrical tube made of slightly elastic and flexible material and having at least a partially closed end and an opposite open end for permitting insertion or egress of a predetermined number of coins of the same denomination into or from the holder. This open end portion defines an inner cylindrical bulge having bevelled outer and inner edge faces, the latter merging with the inside surface of the main wall of the holder. The inner diameter of the main wall is greater than the diameter of the coins, but the inner diameter of the bulge is slightly smaller than the diameter of the coins, so that the latter are frictionally retained by the bulge within the holder. Preferably, the width of the cylindrical face of the bulge is about equal to the difference in the position of the endmost coin of the stack depending on whether all the coins of the stack are in new or worn-out condition; this permits to account for variable coin thickness, according to their wear condition, while retaining exactly the same number of coins.

The holder may be made of an opaque material and could then have see-through apertures, or could be made of a transparent material. The coins are releasable from the holder by simply striking the open end of the downwardly-inclined holder against a hard surface.

DETAILED DESCRIPTION OF THE DRAWINGS

Figure 1:
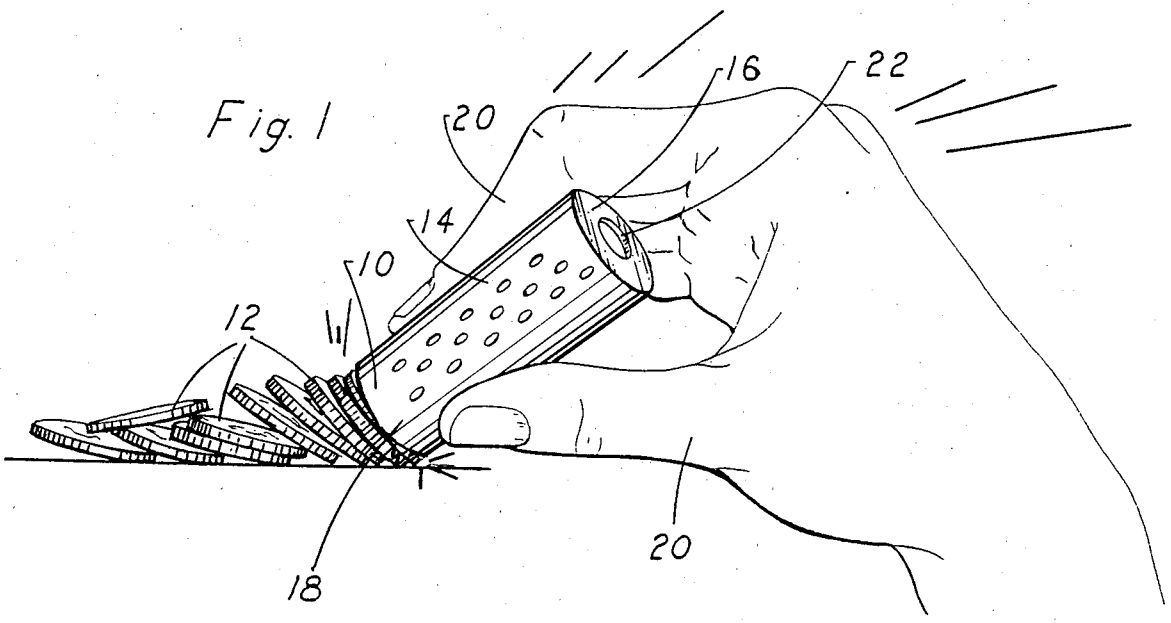
FIG. 1 is a perspective view of the coin holder and of a plurality of coins in the process of being released by the hand of a user.
Figure 2:
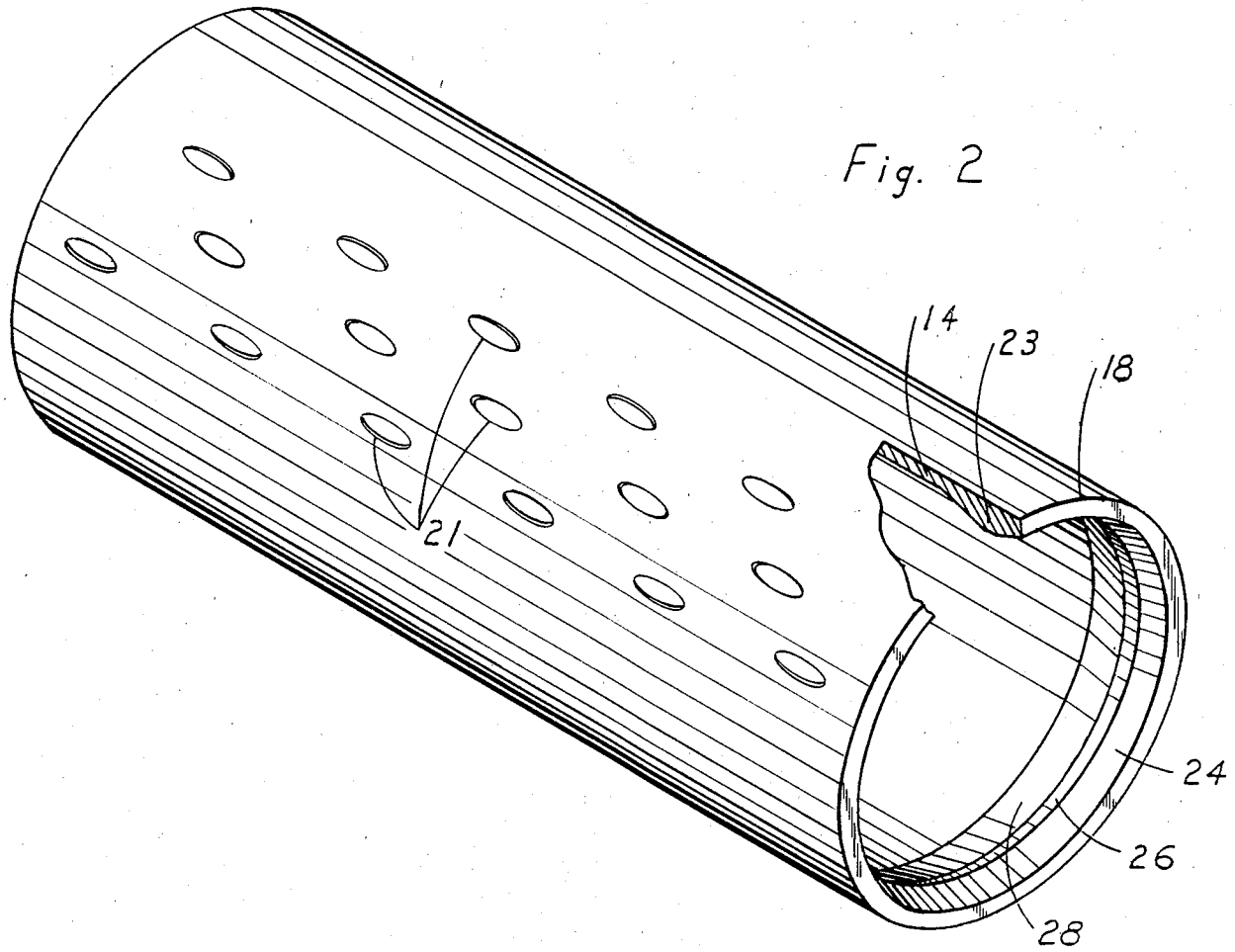
FIG. 2 is an enlarged perspective view, partially cut away of the emptied coin holder.

Referring to FIGS. 1 and 2 of the drawings, there is shown a coin holder 10 capable of containing a plurality of coins 12. of the same denomination. The coin holder is a hollow cylinder defining a cylindrical main wall 14, an end closure wall 16, and an open-end portion 18. Holder 10 is made of slightly flexible and elastic material. for instance a synthetic resin, such as polyethylene. Egress of coins 12 is obtained as follows: the fingers 20 of the user hold the coin holder in downwardly-inclined position; slightly press opposite portions of open end portion 18; and strike the end portion 18 against a flat surface, for instance against one's hand or a table surface. However, holder 10 is sufficiently sturdy to retain the coins 12, even if the filled coin holder is accidentally dropped on the ground. Wall 14 may have a plurality of see-through apertures 21, preferably in co-alignment along the longitudinal axis thereof, to allow the user to readily known whether the coins held therewithin are geniune coins. End closure wall 16 may have a central opening 22 for the insertion of a pencil or the like to push out any coin which might have remained in the holder. The inside diameter of wall 14 is slightly larger than the diameter of the coins of like denomination to be freely stacked therein. The open end portion 18 defines an inner bulge 23 having three circular faces: namely an outer inwardly-enlarging bevelled face 24, an intermediate cylindrical face 26 and an inner inversely bevelled face 28. Faces 24 and 28 are oppositely bevelled, both flaring away from intermediate face 26, to equally facilitate ingress and egresss of coins 12 into and from the coin holder 10 upon appropriate application of pressure. Cylindrical face 26 has a diameter which is slightly less than that of the coins 12, so as to frictionally engage the peripheral edge of the endmost coin 12A of the stack and elastically retain coin 12A. The width of the cylindrical face 26 is about equal to the difference in the position of the endmost coin 12A of the stack of coins 12 filling the holder depending on whether the coins of the stack are in new or worn-out condition. Outer face 24 is normally narrower than inner face 28 to make the holder as short as possible. Inner face 28 merges with the inner surface of the main wall 14 and with cylindrical face 26, and has a width larger than the thickness of coins 12. Face 24 has an outer end of a diameter at least equal to the inner diameter of the wall 14.

Figure 6:
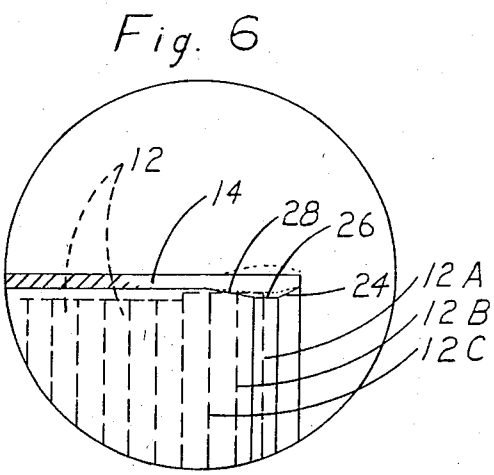
FIGS. 5 and 6 are enlarged longitudinal sections of a portion of the coin holder, taken within circle 5 of FIG. 3, containing coins in new condition in FIG. 5 and in worn-out condition in FIG. 6.
Figure 5:
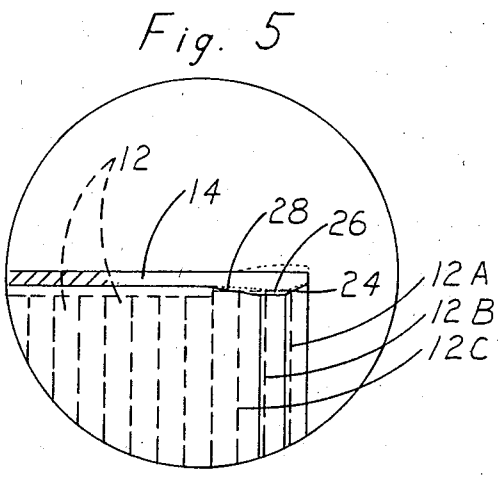
Figure 4:
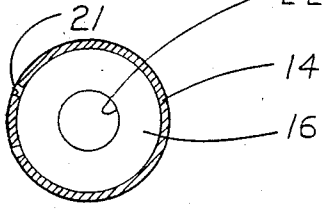
FIG. 4 is a cross-section taken along line 4—4 of FIG. 3.
Figure 3:
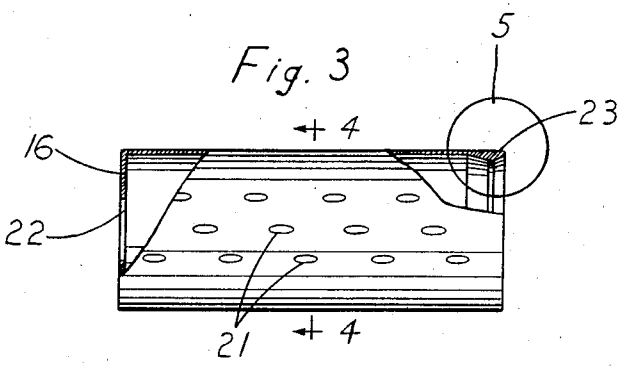
FIG. 3 is a side view of the coin holder with both ends thereof being partly broken away.

FIGS. 5 and 6 show that the coin holder 10 is able to retain a predetermined number of coins 12 of variable wear condition and, therefore, variable thickness within limits, since the endmost coin 12A may be variably positioned over intermediate face 26.

FIG. 5 shows coins in a new condition; FIG. 6 coins in worn-out condition. The coins are pushed into the holder without having to be counted. If a supplemental coin is added inward of coin 12A, the coin will not hold and will fall back, irrespective of the degree of wear of the coins 12. Coin 12A is frictionally retained by cylindrical face 26. The following coin 12B in FIG. 6 or with following coins 12B and 12C in FIG. 5 are frictionally engaged at their periphery by inner bevelled face 28.

Endmost coin 12A and one or two of the following coins form a plug which positively retain the remaining, freely held coins in the holder under normal handling of the coin-filled holder. Yet this plug is easily released upon sufficient outward pressure exerted on the plug, for instance by striking the filled holder against an underlying surface, as shown in FIG. 1.

The inclination and, therefore, the width of inner face 28 is selected in accordance with the number of coins selected to form the plug. Since the remaining coins of the stack are freely held in holder 10, they can rotate about a diametrical axis when the holder is partially filled. Therefore, ingress and egress of the coins are facilitated, because most of the coins can be inserted or removed while on edge and while slightly flattening the open end portion 18 so that bulge 23 becomes out of round to make a free passage for the coins.

The term "coin" used in the description and claims includes not only money coins but tokens, chips and the like disc-shaped pieces.

I claim:

1. A one-piece coin holder made of slightly elastic and flexible material for holding a stack of a predetermined number of coins of like diameter and thickness, said holder having a main cylinder wall, a closure wall at one end and an opposite open-end portion, the latter permitting insertion or egress of said coins into and from said holder, said open-end portion defining an inner, continuous, apertureless, circular bulge having an intermediate cylindrical face, outer and inner bevelled faces flaring away from said intermediate face, said inner bevelled face merging with the inside surface of said main wall and with said intermediate cylindrical face, the inner diameter of said main wall being slightly larger than the diameter of said coins, such that the latter can be freely stacked therein, the inner diameter of said intermediate cylindrical face being slightly smaller than the diameter of said coins, such that said intermediate cylindrical face will frictionally engage the peripheral edge of the endmost coin of the stack, said inner bevelled face having a width larger than the thickness of said coins, and frictionally engaging the peripheral edge of the coin next following the endmost coin of the stack, so that at least said two endmost coins of the stack form a plug which retains the remaining freely-held coins in the holder under normal handling of the coin-filled holder, said plug being released from frictional engagement with said inner and intermediate faces upon sufficient outward pressure exerted on said plug.

2. A coin holder as defined in claim 1, wherein said intermediate face has a width about equal to the difference in the position of the endmost coin of the stack, depending on whether all the coins of the stack are in new or worn-out condition, so as to hold in the holder exactly the same predetermined number of coins irrespective of their wear condition.

* * * * *